US009715843B2

(12) United States Patent
Li

(10) Patent No.: US 9,715,843 B2
(45) Date of Patent: Jul. 25, 2017

(54) METHOD AND DEVICE OF ESTIMATING IMAGE STICKING GRADE OF DISPLAY

(71) Applicant: BOE TECHNOLOGY GROUP CO., LTD., Beijing (CN)

(72) Inventor: Wusheng Li, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 71 days.

(21) Appl. No.: 14/499,674

(22) Filed: Sep. 29, 2014

(65) Prior Publication Data

US 2015/0371576 A1 Dec. 24, 2015

(30) Foreign Application Priority Data

Jun. 20, 2014 (CN) ..... 2014 1 0277811

(51) Int. Cl.
*G09G 3/36* (2006.01)
*G09G 3/00* (2006.01)

(52) U.S. Cl.
CPC ..... *G09G 3/006* (2013.01); *G09G 2320/0257* (2013.01); *G09G 2320/046* (2013.01)

(58) Field of Classification Search
CPC ..... G09G 3/3618
See application file for complete search history.

(56) References Cited

U.S. PATENT DOCUMENTS

2001/0043755 A1* 11/2001 Edgar ..... G06T 5/002 382/264
2002/0067325 A1* 6/2002 Choi ..... G09G 3/3648 345/89
2004/0183812 A1* 9/2004 Raskar ..... G06T 15/02 345/582
2004/0183925 A1* 9/2004 Raskar ..... G06T 15/02 348/239
2008/0303766 A1* 12/2008 Lee ..... G09G 3/006 345/89
2010/0220124 A1* 9/2010 Chen ..... G09G 3/3648 345/694

* cited by examiner

*Primary Examiner* — Jennifer Mehmood
*Assistant Examiner* — Carl Adams
(74) *Attorney, Agent, or Firm* — Westman, Champlin & Koehler, P.A.

(57) ABSTRACT

It is provided a method of estimating an image sticking grade of a display, comprising steps of: displaying a first image in a first frame and a second image in a second frame on the display; switching the display, at at least two sampling times, to display the first image, and then obtaining brightness change factors and image sticking area factors for an image sticking displayed on the display at each sampling time to determine at least two image sticking grades corresponding to each sampling time, wherein an image sticking fading period is set as interval time between two adjacent sampling times to perform an image sticking fading process of the display; and determining a change trend of the image sticking grades of the display during the image sticking fading process based on the at least two image sticking grades when the image sticking stops fading. From the change trend, adverse influences of the image sticking on the display performance may be reflected accurately and fully such that related comprehensive modifications may be made by the skilled based on defects caused by the image sticking in the display.

16 Claims, 4 Drawing Sheets

METHOD AND DEVICE OF ESTIMATING IMAGE STICKING GRADE OF DISPLAY

CROSS-REFERENCE TO RELATED APPLICATION

This application claims the benefit of Chinese Patent Application No. 201410277811.6 filed on Jun. 20, 2014 in the State Intellectual Property Office of China, the whole disclosure of which is incorporated herein by reference.

BACKGROUND OF THE INVENTION

Field of the Invention

Embodiments of the present invention relate to field of display, and particularly, to a method and a device of estimating an image sticking grade of a display.

Description of the Related Art

In field of flat panel display, a liquid crystal display (LCD) becomes applied increasingly in high-performance display field due to compact volume, low power consumption, non-radiation and low manufacturing cost.

In order to improve performance and quality of a LCD, it is necessary to measure and estimate performance indexes of the LCD in the process of manufacture, such as, resolution, brightness, contrast degree, color gamut, response time, Mura, and image sticking grade, etc. The image sticking exists in a common LCD. Specifically, when the LCD is driven to display a certain still frame for a long time, ions in the LCD panel may be moved toward upper and lower substrates of the LCD along an electrical field direction and accumulated on a liquid crystal alignment layer. The accumulated ions may create an inner electrical field. When a next frame is displayed on the display, the accumulated ions on the liquid crystal alignment layer do not leave the liquid crystal alignment layer, which causes a residual direct-current voltage existing on the liquid crystal molecules. The residual direct-current voltage leads to the liquid crystal molecules being polarized and held at a certain rotated angle and thus being difficult to be changed. As such, the LCD will display images with defects. For example, the images in the previous frame will be remained on the display panel when the display is switched to display a next frame, which is a so-called image sticking. The image sticking may seriously impact image quality of the display.

In prior art, image sticking of a display is measured by human eyes or a test apparatus. However, as the process of observing the image sticking on the display by eyes is rather subjective and lacks accuracy, it is becoming obsolete in the process of production. The current test apparatus used to perform an image sticking test for a display is commonly configured to obtain the image sticking related data when the image sticking appears on the display and apply the data as basis to estimate an image sticking grade and the performance of the display.

However, the performance of the display in use is often affected by many factors, such as, displaying time, etc. The above image sticking grade can only be used to estimate the performance of the display at the moment that the image sticking appears and cannot fully and actually reflect the influence of the image sticking on the performance of the display in entire displaying process. Thus, by the current method of estimating the image sticking grade with inaccurate defects, it is impossible to fully and accurately estimate the image sticking of the display, thus the technicians cannot purposefully and completely modify the display on the basis of the defects caused by the image sticking, which leads a reduced product quality and a low ratio of good products.

SUMMARY OF THE INVENTION

It is an objective of the embodiments of the present invention to provide a method and a device of estimating an image sticking grade of a display, which is capable of obtaining an image sticking grade and a change law of the image sticking of the display.

According to an embodiment of an aspect of the present invention, there is provided a method of estimating an image sticking grade of a display, comprising steps of:

displaying a first image in a first frame and a second image in a second frame on the display;

switching the display, at at least two sampling times, to display the first image, and then obtaining brightness change factors and image sticking area factors for an image sticking displayed on the display at each sampling time to determine at least two image sticking grades corresponding to each sampling time, wherein an image sticking fading period is set as interval time between two adjacent sampling times to perform an image sticking fading process of the display; and determining a change trend of the image sticking grades of the display during the image sticking fading process based on the at least two image sticking grades when the image sticking stops fading.

According to an embodiment of another aspect of the present invention, there is provided a device of estimating an image sticking grade of a display, comprising:

a test unit configured to make the display to display a first image in a first frame and display a second image in a second frame;

a sampling unit configured to switch the display to display the first image at at least two sampling times and obtain brightness change factors and image sticking area factors for the image sticking displayed on the display so as to determine at least two image sticking grades corresponding to each sampling time;

an image sticking fading unit configured to perform an image sticking fading process of the display during the image sticking fading period, wherein the image sticking fading period is set as interval time between two adjacent sampling times; and an estimating unit configured to determine the change trend of the image sticking grades of the display during the image sticking fading based on the at least image sticking grades when the image sticking stops fading.

BRIEF DESCRIPTION OF THE DRAWINGS

In order to explain the technical solutions in the embodiments of the present invention or in the prior art more explicitly, the figures for the embodiments of the present invention or the prior art will be introduced briefly below. The above and other features of the present invention will become more apparent by describing in detail exemplary embodiments thereof with reference to the accompanying drawings, in which.

DETAILED DESCRIPTION OF PREFERRED EMBODIMENTS OF THE INVENTION

Exemplary embodiments of the present disclosure will be described hereinafter in detail with reference to the attached drawings. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

According to a general concept of the present invention, there is provided a method of estimating an image sticking grade of a display, comprising steps of: displaying a first image in a first frame and a second image in a second frame on the display; switching the display, at least two sampling times, to display the first image, and then obtaining brightness change factors and image sticking area factors for an image sticking displayed on the display at each sampling time to determine at least two image sticking grades corresponding to each sampling time, wherein an image sticking fading period is set as interval time between two adjacent sampling times to perform an image sticking fading process of the display; and determining a change trend of the image sticking grades of the display during the image sticking fading process based on the at least two image sticking grades when the image sticking stops fading. From the obtained change trend, adverse influences of the image sticking on the display performance in the actual displaying process could be reflected accurately and fully such that related comprehensive modifications may be made by the skilled based on defects caused by the image sticking in the display, so as to increase product quality and a ratio of good products.

Figure 1:
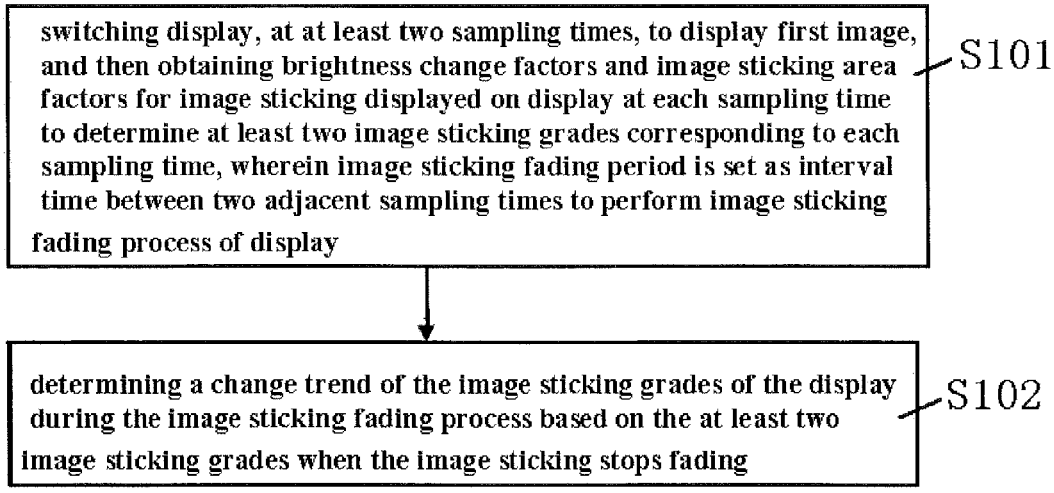
FIG. 1 is a schematic flowchart of a method of estimating an image sticking grade of a display according to an exemplary embodiment of the present invention.

FIG. 1 is a schematic flowchart of a method of estimating an image sticking grade of a display according to an embodiment of the present invention. As shown in FIG. 1, there is provided a method of estimating an image sticking grade of a display, comprising a step of: displaying a first image in a first frame and a second image in a second frame on the display. The above method further comprises a sampling step S101 and a step S102 of determining a change trend of an image sticking grade of the display.

In an exemplary embodiment of the present invention, the sampling step S101 comprises: at at least two sampling times, such as, at a first sampling time T1 and a second sampling time T2, switching the display to display the first image and obtaining a brightness change factor L and an image sticking area factor A for an image sticking displayed on the display at each sampling time so as to determine a first image sticking grade C1 and a second image sticking grade C2, wherein an image sticking fading period Tx is set as interval time between the two adjacent sampling times (such as, the first sampling time T1 and the second sampling time T2) to perform an image sticking extinction process of the display.

It is noted that the number of sampling and the image sticking fading period Tx may be set depending on situation where the image sticking fades in the display when the image sticking test is performed. The image sticking fading period may be set within a range from 0 hour to 8 hours. For example, the image sticking fading period Tx may be set within a range from 3 hours to 4 hours. When the image sticking fading period Tx is set too short, such as 0 hour, an extent that the image sticking fades is not apparent. That is, change of the image sticking appeared on the display fore and aft the image sticking fading period Tx is very slight. Further, as the image sticking fading period Tx becomes shorter, the number of sampling data on the image sticking becomes greater, thereby increasing workload. On the other hand, when the image sticking fading period Tx is set too long, such as more than 8 hours, change of the image sticking appeared on the display fore and aft the image sticking fading period Tx during the image sticking fading become so considerable that much data on the image sticking at a middle time would be missed, thereby resulting in a distorted sampling result. In addition, the number of sampling may be set within a range from 6 to 25. For example, the number of sampling may be set within a range from 12 to 15. Since the image sticking appeared on the display will stop fading after 25 samplings, i.e., the image sticking appeared on the display is not changed, the subsequent sampling operations will just obtain repeated data on the image sticking and cause increasing workload. Otherwise, when the number of sampling is set less than 6, the change law of the image sticking grades would not be exhibited due to limited sampling data.

The step S102 of determining the change trend of the image sticking grades of the display comprises determining a change trend of the image sticking grades of the display during the image sticking fading based on the first image sticking grade C1 and the second image sticking grade C2 when the fading process of the image sticking ends.

Figure 2:
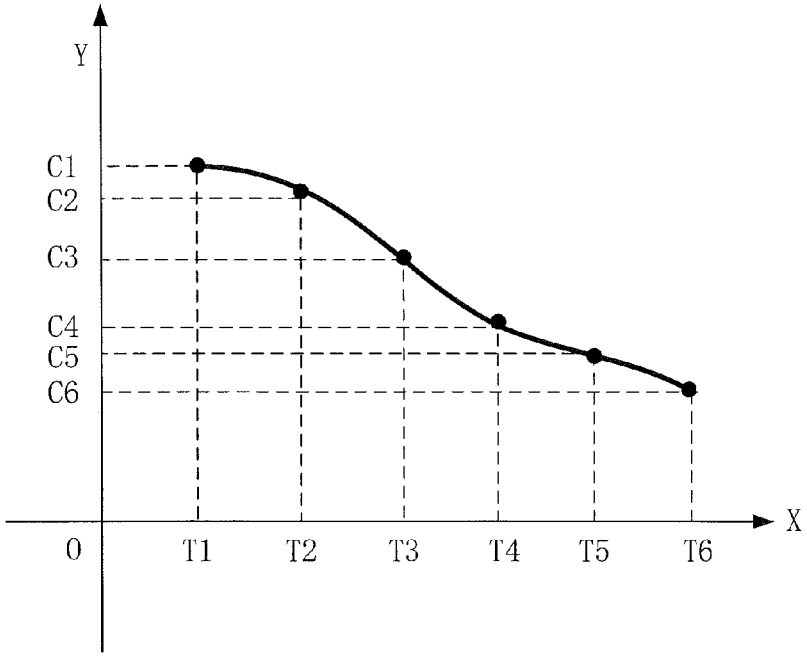
FIG. 2 is a schematic principle view of a change trend of the image sticking grades with a sampling time according to an embodiment of the present invention.

It is noted that the above change trend of the image sticking grades of the display may be revealed as a graph of the image sticking grades with time (as shown in FIG. 2), in which an abscissa axis (x-axis) is represented for time and an ordinate axis (Y-axis) is represented for a plurality of image sticking grades (such as, a first image sticking grade C1, a second image sticking grade C2, a third sticking grade C3 . . . a sixth image sticking grade C6) obtained at a plurality of sampling times. From the graph of the change trend of the image sticking grades with time, the change trend of the image sticking grades of the display within a period (T1, T2 . . . T6) may be obtained so as to identify defects caused by the image sticking during entire displaying process. For example, if it is shown from the above graph that an image sticking grade of the display is faded too fast, defects resulted from deficiency of alignment stability of the liquid crystal, such as, too small pre-obliquity of alignment of liquid crystal, too big step, a low surface roughness of an alignment film, etc., will be considered. In a further example, if it is shown from the above graph that an image sticking grade of the display is faded too slowly, defects caused by, such as, too big residual direct current component in liquid crystal or too low reliability, etc., will be considered. In this way, the above defects may be overcome by limiting direct current component and increasing reliability, such as, providing a liquid crystal with a low residual direct current component and high reliability, or by optimizing a drive voltage, etc.

According to a further exemplary embodiment of the present invention, the step of obtaining the brightness change factors of L1, L2, . . . Ln and the image sticking area factors of A1, A2, . . . An for the image sticking displayed on the display at each of the sampling times of T1, T2, . . . Tn to determine at least two image sticking grade C1, C2, . . . Cn corresponding to each of the sampling times comprises: calculating weighted average values of the brightness change factors of L1, L2, . . . Ln and the image sticking area factors of A1, A2, . . . An at each of the sampling times of T1, T2, . . . Tn so as to the obtain image sticking grades of C1, C2, . . . Cn.

For example, at the first sampling time T1, a first brightness change factor L1 and a first image sticking area factor A1 are obtained and then a first image sticking grade C1 may be calculated as below:

$$C1=L1\times Lw+A1\times Aw;$$

At the second sampling time T2, a second brightness change factor of L2 and a second image sticking area factor of A2 are obtained and then a second image sticking grade C2 may be calculated as below:

$$C2=L2\times Lw+A2\times Aw;$$

In similar way, at the nth sampling time, a nth brightness change factor of Ln and a nth image sticking area factor of An are obtained and then a nth image sticking grade Cn may be calculated as below:

$$Cn=Ln\times Lw+An\times Aw$$

where Lw is a weight of the brightness change factor L1, L2, . . . Ln and Aw is a weight of the image sticking area factors of A1, A2, . . . An. The mentioned weights may be determined by those skilled in the art as required. Generally, the weight Lw of the brightness change factor L1, L2, . . . Ln, and the weight Aw of the image sticking area factors A1, A2, . . . An are selected within a range from 0 to 1.

From this, the weight Lw of the brightness change factor L1, L2, . . . Ln, and the weight Aw of the image sticking area factors of A1, A2, . . . An may be set both as 0.5. Accordingly, during calculation of the image sticking grade, the influence of the brightness change factor L1, L2, . . . Ln, and the image sticking area factors A1, A2, . . . An on the image sticking grade may be in equipartition.

In an embodiment, as for a display panel with a large size, a weight Aw of the image sticking area factor A1, A2, . . . An may be increased to, such as, 0.8 or 1, since the same image stick area may bring bad influence on the display quality in the display panel with the large size, even though the influence occurring in the display panel with the large size (relative to that with a small size) might be smaller in proportion. When the weight Aw of the image sticking area factor A1, A2, . . . An is set as 1, the weight Lw of the brightness change factor L1, L2, . . . Ln may be set as 0.

In an alternative embodiment, as for a display panel with a small size, a weight Lw of the brightness change factor L1, L2, . . . Ln may be increased, such as, up to 1, when a weight Aw of the image sticking area factor A1, A2, . . . An may be reduced to 0 since the influence of the image sticking area on the display quality may be ignored.

It is noted that, when a plurality of image sticking grades, for example, a first image sticking grade C1, a second image sticking grade C2, a third image sticking grade C3, . . . , are obtained, the image sticking grades may be integrated. As integral result may represent an area in numerical calculation field, an integral result of the image sticking grades will reveal the extent of image sticking grades in a more visual way.

Further, the first image may include an image with single grey scale value. The grey scale value is ranged from 0 to 255. For example, an entire grey image with color values of RGB (127, 127, 127) may be selected.

Figure 3:
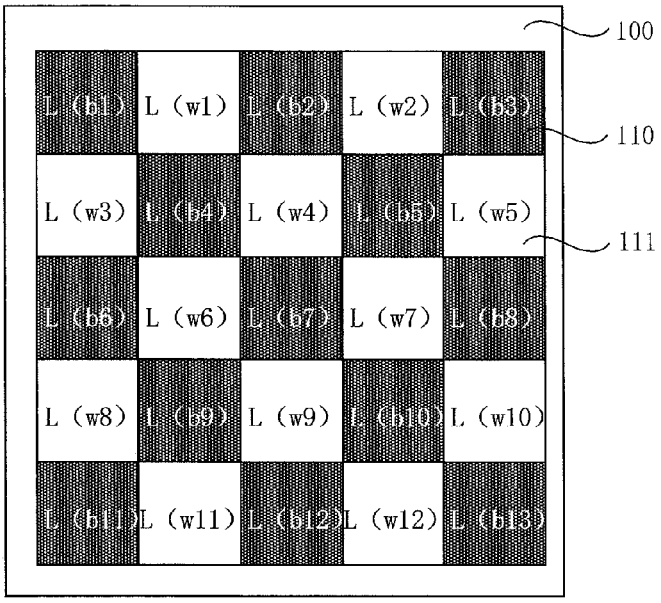
FIG. 3 is a schematic view of an image for testing an image sticking according to an exemplary embodiment of the present invention.

The second image includes a black image, a white image or a checkerboard grid image 100 with alternating black grids and white grids as illustrated in FIG. 3. The checkerboard grid image 100 in black and white includes a plurality of black grids 110 and white grids 111. When the second image is configured in a black image and white image, its contrast with respect to the grey first image is relative large, and it is in favor of observing an image sticking on the display.

When the second image is configured as the checkerboard grid image 100 with alternating black grids and white grids, the image sticking area is easy to be calculated since effective display area of the display is equally divided by the plurality of black grids 110 and white grids 111.

In an exemplary embodiment, the black grids 110 and the white grids 111 have rectangle shape and thus effective display area of the display may be most effectively divided. In addition, the grids may be configured in shapes of circle, triangle, irregular geometry, etc. The present invention is not limited to these shapes.

According to an exemplary embodiment where sampling times include a first sampling time T1 and a second sampling time T2, when a second image includes black image or white image, a method of obtaining a brightness change factor L for the image sticking displayed on the display at the first sampling time T1 and the second sampling time T2 comprises:

at the first sampling time T1 and the second sampling time T2, setting a ratio of an absolute difference value between the brightness values of the display prior to and posterior to the image sticking test to a brightness value of the display before the image sticking test as the brightness change factor L.

For example, at the first sampling time T1, a brightness value of the display before the image sticking test is Lq while a brightness value after the image sticking test is Lh1. Then, the brightness change factor L1 obtained at the first sampling time T1 may be:

$$L_1=\frac{|L_{h1}-Lq|}{Lq};$$

In similar way, the brightness change factor L2 obtained at the second sampling time T2 may be:

$$L_2=\frac{|L_{h2}-Lq|}{Lq}.$$

The brightness value of the display before the image sticking test and the brightness value after the image sticking test are both an average brightness value $\overline{L}$ of the display at the time when the first image is displayed, wherein the average brightness value $\overline{L}$ may be determined by sampling brightness values of all image elements in the display panel of the display, or by equally sampling brightness values of a plurality of (for example, 16) image elements in the display panel and then averaging these brightness values. In order to reduce workload, the average brightness value $\bar{L}$ may be obtained by only sampling brightness values of the image elements at four corners and centre position of the display panel and then averaging them. Of course, the above methods of calculating an average brightness value $\bar{L}$ are described just as examples and other methods will not be illustrated herein but will obvious to be fallen into the scope protected by the present invention.

Figure 4:
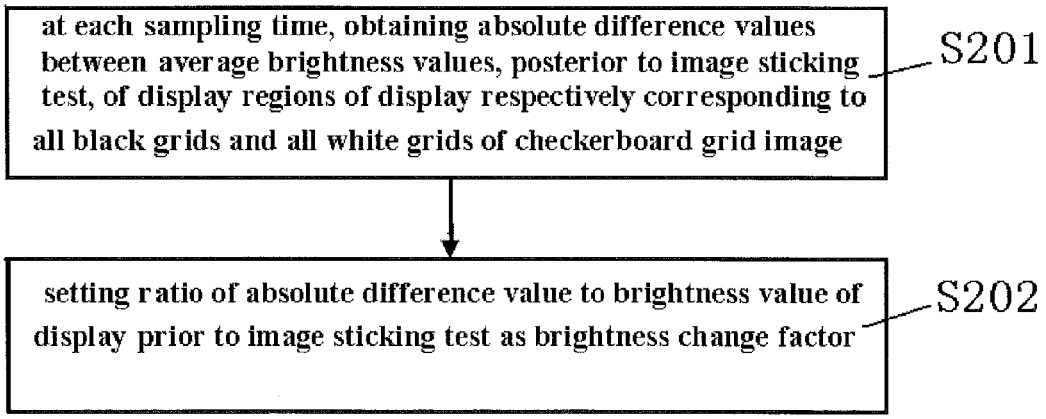
FIG. 4 is a schematic flowchart of a method of calculating a brightness change factor according to an embodiment of the present invention.

According to an exemplary embodiment of the present invention, in the case where the sampling time includes a first sampling time T1 and a second sampling time T2, when the second image includes the checkerboard grid image 100 with alternating black grids and white grids as shown in FIG. 3, as shown in FIG. 4, the method of obtaining a brightness change factor L for the image sticking displayed on the display at each sampling time, such as at the first sampling time T1 and the second sampling time T2, comprises a step S201 and a step S202.

The step S201 comprises: at each sampling time, such as at the first sampling time T1 and the second sampling time T2, obtaining absolute difference values between the average brightness values, after the image sticking test, of the display regions of the display respectively corresponding to all black grids 110 and all white grids 111 in the checkerboard grid image 100.

Specifically, as shown in FIG. 3, for example, at the first sampling time T1, the average brightness value L1(*b*) of the display region corresponding to the black grids 110 may be produced by the below formula:

$$L1(b) = \frac{L(b1) + L(b1) + \ldots + L(b13)}{13};$$

Similarly, the average brightness value L1(*w*) of the display region corresponding to the white grids 111 may be obtained by the below formula:

$$L1(w) = \frac{L(w1) + L(w1) + \ldots + L(w12)}{12}.$$

The absolute difference value between the average brightness values of the display region respectively corresponding to all black grids 110 and all white grids 111 may be expressed as below:

$$|L1(b)-L1(w)|;$$

Similarly, the absolute difference value between the average brightness value Ln(*b*) of the display region corresponding to the black grids 110 and the average brightness value Ln(*w*) of the display region corresponding to the white grids 111 at the nth sampling time Tn may be obtained, the detailed description of which is omitted herein.

The step S202 comprises: setting a ratio of the absolute difference value of the average brightness values at each sampling time to a brightness value Lq of the display before the image sticking test as the brightness change factor L.

Specifically, for example, the brightness change factor L1 at the first sampling time T1 may be obtained by the below formula:

$$L1 = \frac{|L1(b) - L1(w)|}{Lq};$$

The brightness change factor Ln at the nth sampling time Tn may be obtained in a similar way and will be not described in detailed herein.

Further, the step of obtaining the image sticking area factor A for the image sticking displayed on the display at each sampling time comprises: at each sampling time, setting a ratio of an area Mh of the image sticking appeared in the display after the image sticking test to the display area M of the display (effective display area of the display) as the image sticking area factor A.

Specifically, for example, the image sticking area factor A1 at the first sampling time T1 may be written as:

$$A1 = \frac{|Mh - M|}{M};$$

The image sticking area factor An at the nth sampling time Tn may be obtained similarly and will not described in detailed herein.

Figure 5:
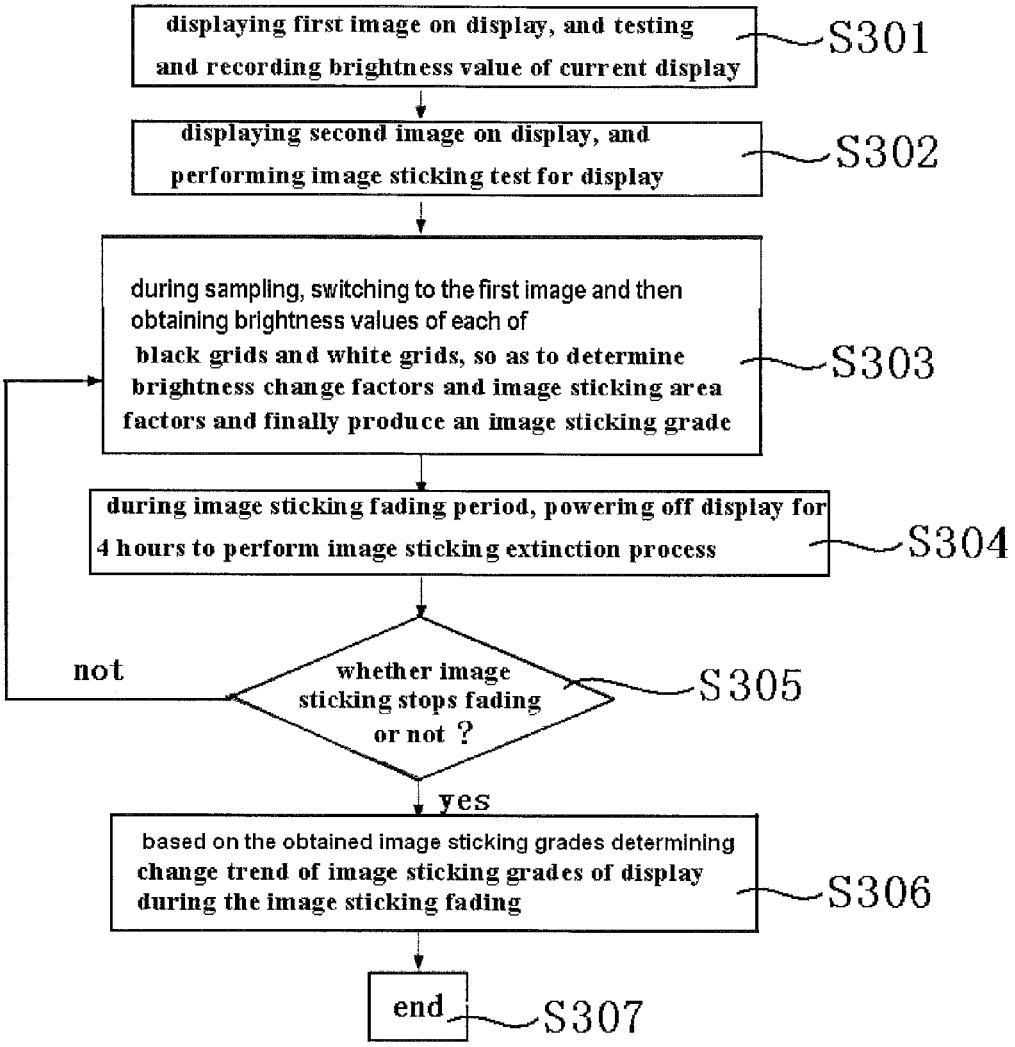
FIG. 5 is a schematic flowchart of a method of estimating an image sticking grade of a display according to another embodiment of the present invention.

FIG. 5 is a schematic flowchart of a method of estimating an image sticking grade of a display according to another exemplary embodiment of the present invention. As shown in FIG. 5, when a first image is provided as a grey image with color values of RGB (127, 127, 127), a second image is provided as the checkerboard grid image 100 with alternating black grids and white grids as shown in FIG. 3, and an image sticking fading period Tx is set as 4 hours, a method of estimating the image sticking grade of the display according to an exemplar embodiment of the present invention comprises steps of:

S301: displaying the first image on the display, and testing and recording a brightness value Lq of the current display;

S302: displaying the second image on the display, and performing an image sticking test for the display;

S303: at a sampling time, switching the display to display the first image and then obtain brightness values L(b1), L(b2) . . . L(b13) and L(w1), L(w2) . . . L(w12) of each of black grids 110 and white grids 111, so as to determine brightness change factors L1, L2 . . . Ln and image sticking area factors A1, A2, . . . An and finally obtain an image sticking grade C;

S304: during an image sticking fading period, powering off the display for 4 hours to perform an image sticking extinction process;

S305: judging whether the image sticking stops fading or not, and performing the step S303 if Not is obtained.

S306: if Yes is obtained at the step of S305, i.e., the image sticking of the display stops fading, determining a change trend of the image sticking grades C1, C2, . . . Cn (as shown in FIG. 2) of the display during the image sticking fading; and S307: ending the method.

In this way, for example, in case of six sampling times, a change trend of the image sticking grades C1, C2, . . . C6 of the display during a time period from T1 to T6 may be obtained to determine defects caused by the image sticking during entire displaying process of the display.

Figure 6:
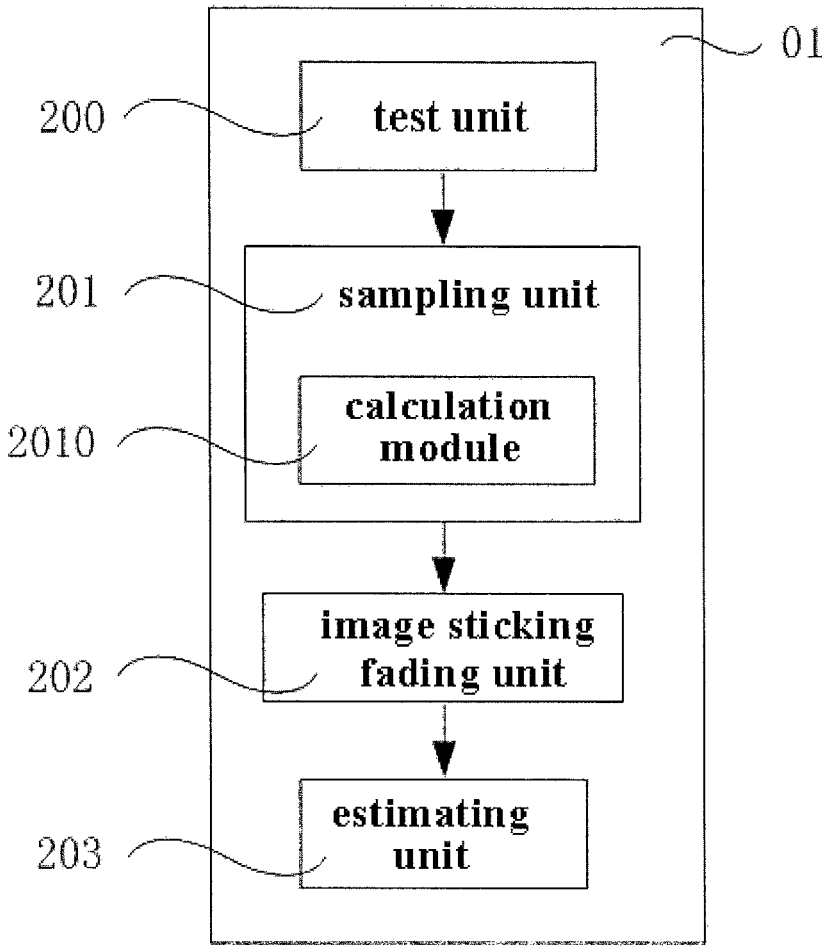
FIG. 6 is a schematic principle block view of a device of estimating an image sticking grade of a display according to an embodiment of the present invention.

According to an embodiment of another aspect of the present invention, an estimating device 01 of an image sticking grade of a display is provided. As shown in FIG. 6, the estimating device 01 comprises a test unit 200, a sampling unit 201, an image sticking fading unit 202 and an estimating unit 203.

The test unit 200 is configured to make the display to display a first image in a first frame and display a second image in a second frame so as to perform an image sticking test for the display.

The sampling unit 201 is configured to switch the display to display the first image at at least two sampling times to obtain brightness change factors L1, L2, . . . Ln and image sticking area factors A1, A2, . . . An for the image sticking displayed on the display so as to determine at least two image sticking grades C1, C2, . . . Cn.

The image sticking fading unit 202 is configured to perform an image sticking fading process of the display during the image sticking fading period Tx, wherein the image sticking fading period Tx is set as interval time between two adjacent sampling times (for example, a first sampling time T1 and a second sampling time T2).

It is noted that the number of the sampling time and the image sticking fading period Tx may be set depending on the situation where the image sticking fades in the display when the image sticking test is performed. For example, the image sticking fading period Tx may be set within a range from 0 to 8 hours. In an exemplary embodiment, the image sticking fading period Tx may be set within a range from 3 to 4 hours. If the image sticking fading period Tx is set too short, such as 0 hour, image sticking fading effect is not apparent. That is, change of the image sticking appeared prior to and posterior to the image sticking fading period Tx is very slight. Further, as the image sticking fading period Tx is reduced, the number of sampling the image sticking data is increased, thereby increasing workload. On the other hand, if the image sticking fading period Tx is set too long, such as exceeds 8 hours, change of the image sticking appeared prior to and posterior to the image sticking fading period Tx becomes so considerable that data of the image sticking at a certain middle time would be missed, thereby causing distorted sampling results. Since the image sticking appeared on the display stops fading after 25 sampling operations, i.e., the image sticking on the display being not changed after 25 sampling operations, the subsequent sampling operations would just obtain repeated data on the image sticking and cause increasing workload. Otherwise, when the number of sampling operation is set less than 6, the change law of the image sticking grades would not be exhibited due to limited sampling data. Therefore, the number of sampling times may be set within a range from 6 to 25. For example, the number of sampling times may be set within a range from 12 to 15.

The estimating unit 203 is configured to determine a change trend of the image sticking grades of the display during the image sticking fading based on the image sticking grades C1, C2, . . . Cn, when the image sticking stops fading.

It is noted that the above change trend of the image sticking grades of the display may be revealed as a graph of the image sticking grades with time (as shown in FIG. 2), in which an abscissa axis (x-axis) is represented for time and an ordinate axis (Y-axis) is represented for a plurality of image sticking grades (such as, a first image sticking grade C1, a second image sticking grade C2, a third sticking grade C3 . . . a sixth image sticking grade C6) obtained at a plurality of sampling times. From the graph of the change trend of the image sticking grades with time, the change trend of the image sticking grades of the display within a time period (T1, T2 . . . T6) may be obtained so as to identify defects caused by the image sticking during entire displaying process. For example, if it is shown from the above graph that an image sticking of the display is faded too fast, defects caused by deficiency of alignment stability of the liquid crystal will be considered, such as, too small pre-obliquity of alignment of liquid crystal, too big step, a low surface roughness of an alignment film, etc. In a further example, if it is shown from the above graph that an image sticking grade of the display is faded too slowly, defects caused by, such as, too big residual direct current component in liquid crystal or too low reliability, etc., will be considered. In this way, the above defects may be overcome by limiting direct current component and increasing reliability, such as providing a liquid crystal with a low direct current component and high reliability, or by optimizing a drive voltage, etc.

Embodiments of the present invention provide an estimating device of an image sticking grade of a display, comprising: a test unit configured to make the display to display a first image in a first frame and display a second image in a second frame; a sampling unit configured to switch the display to display the first image at at least two sampling times and obtain brightness change factor and image sticking area factor for the image sticking displayed on the display at each sampling time so as to obtain at least two image sticking grades corresponding to each sampling time; an image sticking fading unit configured to perform an image sticking extinction process of the display during the image sticking fading period, wherein the image sticking fading period is set as interval time between two adjacent sampling times; and an estimating unit configured to determine a change trend of the image sticking grades of the display during the image sticking fading based on the at least two image sticking grades, when the image sticking stops fading. At this way, from the above change trend, an adverse influence of the image sticking on the display performance in the actual displaying process of the display may be reflected accurately and fully such that related comprehensive modification may be made by the skilled based on defects in the display.

Further, the sampling unit 201 comprises a calculation module 2010 configured to calculate weighted average values of the brightness change factors L1, L2, . . . Ln and the image sticking area factors A1, A2, . . . An obtained at each sampling time, so as to determine the image sticking grades C1, C2, . . . Cn.

For example, at the first sampling time T1, a first brightness change factor L1 and a first image sticking area factor A1 are obtained and then a first image sticking grade C1 may be calculated by the calculating module 2010 as below:

$$C1=L1\times Lw+A1\times Aw;$$

At the second sampling time T2, a second brightness change factor of L2 and second image sticking area factor of A2 are obtained and then a second image sticking grade C2 may be calculated by the calculating module 2010 as below:

$$C2=L2\times Lw+A2\times Aw;$$

In similar way, at the nth sampling time, a nth brightness change factor of Ln and nth image sticking area factor of An are obtained and then a nth image sticking grade Cn may be calculated by the calculating module 2010 as below:

$$Cn=Ln\times Lw+An\times Aw$$

where Lw is a weight of the brightness change factor, L1, L2, . . . Ln and Aw is a weight of the image sticking area factors of A1, A2, . . . An. The mentioned weights may be determined by those skilled in the art as required. Generally, the weight Lw of the brightness change factor L1, L2, . . . Ln and the weight Aw of the image sticking area factors of A1, A2, . . . An are selected within a range from 0 to 1.

From this, the weight Lw of the brightness change factor L1, L2, . . . Ln and the weight Aw of the image sticking area factors of A1, A2, . . . An may be set both as 0.5 by the calculation module 2010. Accordingly, during calculation of the image sticking grade, the influence of the brightness change factors of L1, L2, . . . Ln and the image sticking area factors of A1, A2, . . . An on the image sticking grade may be in equipartition.

In an exemplary embodiment, as for a display panel with a large size, a weight Aw of the image sticking area factors A1, A2, . . . An may be increased by the calculation module 2010 to, such as, 0.8 or 1, since the same image sticking area may bring bad influence on the display quality in the display panel with the large size, even though the influence in the display panel with the large size (relative to a display panel with a small size) might be smaller in proportion. When the weight Aw of the image sticking area factors A1, A2, . . . An is set as 1, the weight Lw of the brightness change factors L1, L2, . . . Ln may be set as 0.

In an alternative embodiment, as for a display panel with a small size, a weight Lw of the brightness change factors L1, L2, . . . Ln may be increased by the calculation module 2010, such as, up to 1, while a weight Aw of the image sticking area factors A1, A2, . . . An may be set as 0 since the influence of the image sticking area on the display quality may be ignored.

It is noted that, when a plurality of image sticking grades, for example, a first image sticking grade C1, a second image sticking grade C2, a third image sticking grade C3, . . . , are obtained, the image sticking grades may be integrated by the calculation module 2010. As an integral result may represent an area in numerical calculation field, an integral result of the image sticking grades will reveal the extent of image sticking grades in a more visual way.

In an embodiment, the sampling unit is further configured to take a ratio of the absolute difference value between the brightness values of the display prior to and posterior to the image sticking test to the brightness value of the display before the image sticking test as the brightness change factor.

The sampling unit is further configured to obtain the absolute difference value between the average brightness values in the display regions of the display respectively corresponding to all the black grids and all the white grids of the checkerboard grid image at each sampling time when the second image includes the checkerboard grid image, and take a ratio of absolute difference value to the brightness value of the display before the image sticking test as the brightness change factor.

The sampling unit is further configured to take a ratio of area of the image sticking appeared on the display after the image sticking test to the displaying area of the display as the image sticking area factor.

In the embodiment of the estimating device of the image sticking grade of the display, the image sticking fading period may be set within a range from 0 to 8 hour.

It is appreciated that the entire or part steps of the embodiment of the above method may be performed through program instructions correlated with hardware. The mentioned program may be stored in a computer-readable storage medium and may be implemented to perform the steps of the embodiment of the above method. The storage medium includes ROM, RAM, magnetic disc or optical disc and various mediums which are able to store program code.

The above embodiments are only illustrative, instead of limiting the present invention. Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A method of estimating an image sticking grade of a display, comprising steps of:

displaying a first image in a first frame and a second image in a second frame on the display;

switching the display, at at least two sampling times, to display the first image, and then obtaining brightness change factors and image sticking area factors for an image sticking displayed on the display at each sampling time to determine at least two image sticking grades corresponding to each sampling time, wherein an image sticking fading period is set as interval time between two adjacent sampling times to perform an image sticking fading process of the display;

determining a change trend of the image sticking grades of the display during the image sticking fading process based on the at least two image sticking grades when the image sticking stops fading; and identifying defects caused in the image sticking during displaying process of the display, wherein if it is shown from the change trend that the image sticking grade of the display is faded too fast, defects resulted by deficiency of alignment stability of liquid crystal of the display are considered; and if it is shown from the change trend that the image sticking grade of the display is faded too slowly, defects caused by too big residual direct current component in the liquid crystal or too low reliability are considered.

2. The method of estimating the image sticking grade of the display according to claim 1, wherein, the step of obtaining the brightness change factors and the image sticking area factors for the image sticking displayed on the display at each sampling time to determine the at least two image sticking grades corresponding to each sampling time comprises:

calculating weighted average values of the brightness change factors and the image sticking area factors at each of the sampling times so as to obtain the image sticking grades.

3. The method of estimating the image sticking grade of the display according to claim 2, wherein, the first image includes an image with single grey scale value;

the second image includes a black image, a white image or a checkerboard grid image with black grids and white grids.

4. The method of estimating the image sticking grade of the display according to claim 3, wherein, when the second image comprises the black image or the white image, the step of obtaining the brightness change factor for the image sticking displayed on the display at each sampling time comprises:

at each sampling time, setting a ratio of the absolute difference value between the brightness values of the display prior to and posterior to the image sticking test to the brightness value of the display prior to the image sticking test as the brightness change factor.

5. The method of estimating the image sticking grade of the display according to claim 4, wherein, the step of obtaining the image sticking area factor for the image sticking displayed on the display at each sampling time comprises:

at each sampling time, setting a ratio of area of the image sticking appeared on the display after the image sticking test to the display area of the display as the image sticking area factor.

6. The method of estimating the image sticking grade of the display according to claim 3, wherein, when the second image comprises the checkerboard grid image with black grids and white grids, the step of obtaining the brightness change factor for the image sticking displayed on the display at each sampling time comprises:

at each sampling time, obtaining the absolute difference values between the average brightness values, posterior to the image sticking test, of the display regions of the display respectively corresponding to all the black grids and all the white grids of the checkerboard grid image; and setting a ratio of absolute difference value to the brightness value of the display prior to the image sticking test as the brightness change factor.

7. The method of estimating the image sticking grade of the display according to claim 5, wherein, the step of obtaining the image sticking area factor for the image sticking displayed on the display at each sampling time comprises:

at each sampling time, setting a ratio of area of the image sticking appeared on the display after the image sticking test to the display area of the display as the image sticking area factor.

8. The method of estimating the image sticking grade of the display according to claim 1, wherein, the image sticking fading period is set within a range from 0 to 8 hours.

9. The method of estimating the image sticking grade of the display according to claim 2, wherein, the step of calculating weighted average values of the brightness change factors and the image sticking area factors at each of the sampling times comprises:

setting a weight of the brightness change factors and the image sticking area factors are within a range from 0 to 1, respectively.

10. The device of estimating the image sticking grade of the display according to claim 9, wherein, the image sticking fading period is set within a range from 0 to 8 hours.

11. An device of estimating an image sticking grade of a display, comprising:

a test unit configured to make the display to display a first image in a first frame and display a second image in a second frame;

a sampling unit configured to switch the display to display the first image at at least two sampling times and obtain brightness change factors and image sticking area factors for the image sticking displayed on the display so as to determine at least two image sticking grades corresponding to each sampling time;

an image sticking fading unit configured to perform an image sticking fading process of the display during the image sticking fading period, wherein the image sticking fading period is set as interval time between two adjacent sampling times; and an estimating unit configured to determine the change trend of the image sticking grades of the display during the image sticking fading, based on the at least two image sticking grades when the image sticking stops fading, to identify defects resulting in the image sticking during displaying process of the display, wherein if it is shown from the change trend that the image sticking grade of the display is faded too fast, defects resulted by deficiency of alignment stability of liquid crystal of the display are considered; and if it is shown from the change trend that the image sticking grade of the display is faded too slowly, defects caused by too big residual direct current component in the liquid crystal or too low reliability are considered.

12. The device of estimating the image sticking grade of the display according to claim 11, wherein, the sampling unit comprises:

a calculation module configured to calculate weighted average values of the brightness change factors and the image sticking area factors obtained at each sampling time, so as to determine the image sticking grades.

13. The device of estimating the image sticking grade of the display according to claim 12, wherein, the sampling unit is further configured to set a ratio of the absolute difference value between the brightness values of the display prior to and posterior to the image sticking test to the brightness value of the display prior to the image sticking test as the brightness change factor.

14. The device of estimating the image sticking grade of the display according to claim 13, wherein, the sampling unit is further configured to, at each sampling time, set a ratio of area of the image sticking appeared on the display after the image sticking test to the display area of the display as the image sticking area factor.

15. The device of estimating the image sticking grade of the display according to claim 12, wherein, the sampling unit is further configured to obtain the absolute difference values between the average brightness values, after the image sticking test, in the display regions of the display respectively corresponding to all the black grids and all the white grids of the checkerboard grid image at each sampling time when the second image includes the checkerboard grid image, and set a ratio of absolute difference value to the brightness value of the display before the image sticking test as the brightness change factor.

16. The device of estimating the image sticking grade of the display according to claim 15, wherein, the sampling unit is further configured to, at each sampling time, set a ratio of area of the image sticking appeared on the display after the image sticking test to the display area of the display as the image sticking area factor.

* * * * *